United States Patent [19]

Quartino et al.

[11] 4,452,222

[45] Jun. 5, 1984

[54] CABLE GUARD FOR A COMPOUND BOW

[75] Inventors: Miguel A. Quartino, Bridgeton; Thomas R. Mundt, St. Louis, both of Mo.

[73] Assignee: Hoyt/Easton Archery Co., Bridgeton, Mo.

[21] Appl. No.: 364,247

[22] Filed: Apr. 1, 1982

[51] Int. Cl.[3] ..... F41B 5/00

[52] U.S. Cl. ..... 124/24 R; 124/88; 124/DIG. 1

[58] Field of Search ..... 124/88, 23 R, 91, DIG. 1, 124/24 R

[56] References Cited

U.S. PATENT DOCUMENTS

| | | | |
|---|---|---|---|
| 2,592,696 | 4/1952 | Hoody | 46/1 G X |
| 3,010,447 | 11/1961 | Roemer | 124/91 |
| 3,756,215 | 9/1973 | Black | 124/91 |
| 4,377,152 | 3/1983 | Saunders | 124/88 |

OTHER PUBLICATIONS

"Trim Line" Cable Saver, *Archery Magazine*, p. 4, dated Jun. 1979.

"York's New Excalibre", *Bow and Arrow Magazine*, Jun. 1982, pp. 20–22.

*Primary Examiner*—Richard C. Pinkham
*Assistant Examiner*—Scott L. Brown
*Attorney, Agent, or Firm*—Charles E. Markham

[57] ABSTRACT

A cable guard for a compound bow comprises a rod attached at one end to the bow handle and extends therefrom beyond the cables when the bow is fully drawn and is spaced laterally from the bow string sufficiently to avoid any interference therewith; and a cable retaining member rotatably and slidably mounted on the rod has two bores therethrough perpendicular to the rod for slidably receiving the cables thereby to hold them in lateral spaced relationship wih the bow string.

1 Claim, 5 Drawing Figures

10
20
22
24
26
18
15
19
28
14
17
16
12

30
34
32
2
16
17
28
14a
16a
14
12

CABLE GUARD FOR A COMPOUND BOW

This invention relates to compound archery bows and particularly to an improved means for maintaining the required lateral spacing of the cables from the bow string to permit free passage of an arrow.

BACKGROUND OF THE INVENTION

The cables and bow strings of current compound bows are usually too closely spaced laterally, with respect to the plane of the bow and bow string to permit the free passage of an arrow. A conventional solution of this problem is to provide a rod, called a cable guard, connected at one end to the bow handle section and projecting therefrom between the cables and bow string and arranged to bear against the cables so as to push them sufficiently away laterally from the bow string to provide the required clearance for the free passage of arrows.

Another problem is encountered however when employing this conventional cable guard rod means for assuring that the required lateral spacing of the cables from the bow string is maintained, i.e.: When the cable guard rod is positioned between the bow string and cables and arranged so as to push the cables laterally just sufficiently away from the bow string to provide the required clearance, the bow string slaps against the rod when released from a drawn position and frequently comes to rest on the wrong side of the rod. This interference occurs as the result of a bounce back and lateral vibration of the bow string when it arrives in its braced position after being released from a drawn position. To solve this problem it has been customary to move the rod laterally away from the bow string sufficiently to avoid this interference with the bow string. When this is done the cables are stressed considerably more than is necessary to assure free passage of an arrow.

It is of course highly desirable to minimize the lateral displacement of the cables so as to minimize stress and wear of the cables and minimize any tendency to twist the bow limbs. Applicants have invented a cable guard by which the cables may be displaced just sufficiently to provide the required clearance for the free passage of an arrow without interfering with the bow string under shooting conditions.

OBJECTS OF THE INVENTION

The primary object of the invention is to provide a generally new and improved cable guard for a compound bow which is reliable in operation, of simple and economical construction any by which displacement and stressing of the cables may be limited to that required to permit free passage of an arrow and without interfering with any movement of the bow string under shooting conditions.

A further object is to provide a cable retaining member arranged for convenient mounting on an existing, conventional cable guard rod and when mounted thereon permits positioning the existing cable guard rod laterally from the bow string sufficiently to avoid any interference therewith while limiting the lateral displacement and stressing of the cables to that which is required for free passage an arrow.

Further objects and advantage will appear from the following description when read in connection with the accompanying drawing.

IN THE DRAWING

DESCRIPTION OF A PREFERRED FORM OF THE INVENTION

Figures 1, 2, 3, 4, 5:
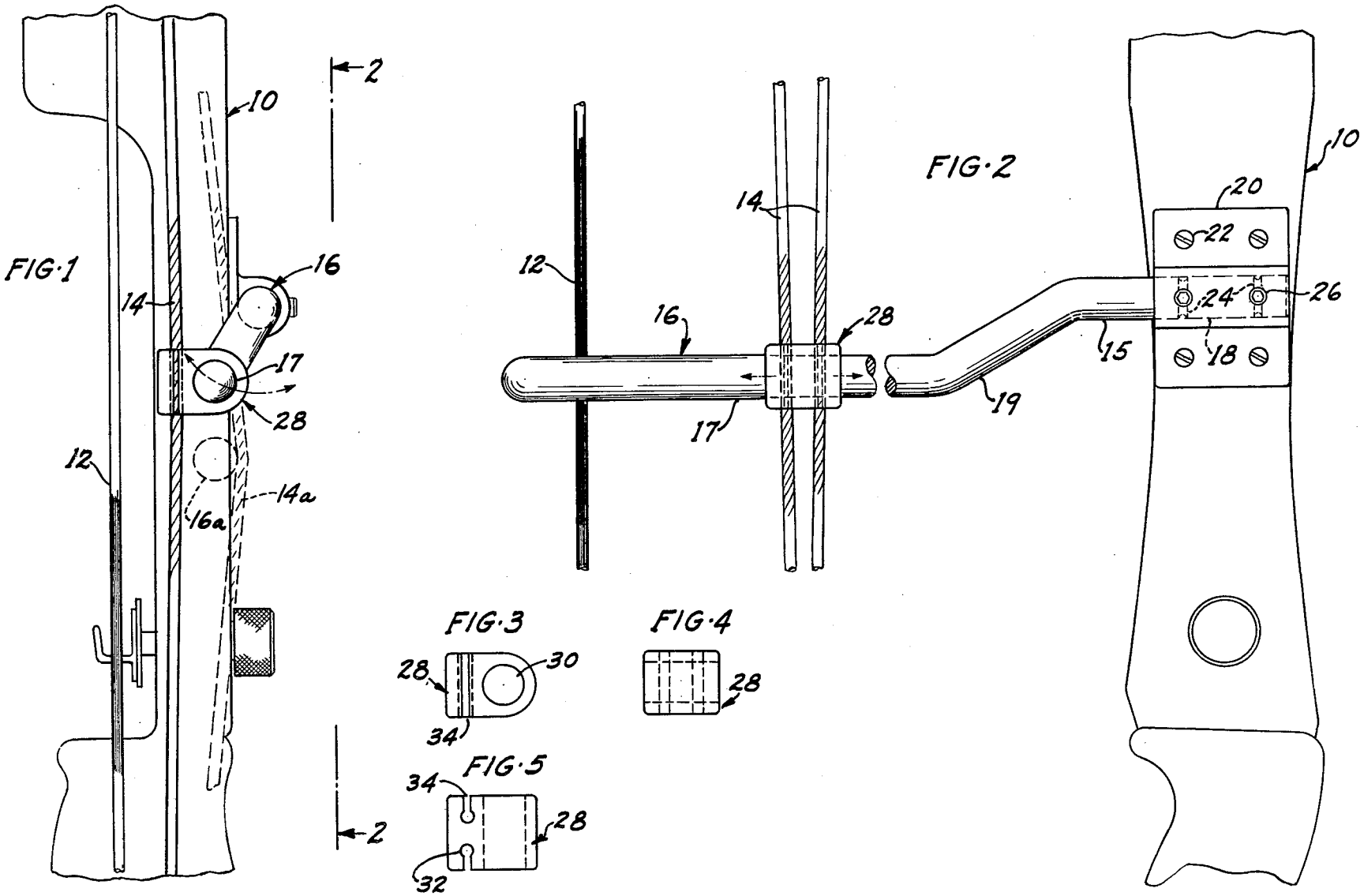
FIG. 1 is a fragmentary elevational view of the central portion of a typical compound bow from the archer's side incorporating a cable guard constructed in accordance with the present invention.
FIG. 2 is a side elevational view of the bow portion shown in FIG. 1, looking along line 2—2 of FIG. 1.
FIGS. 3, 4 and 5 are plan and elevational view of the cable retaining member.

Refering to the drawings, an intermediate fragmentary portion of the handle section of a conventional compound bow is indicated at 10 with adjacent portions of the bow string 12 and cables 14 shown in their positions relative to each other and to the handle section 10 when the bow is braced. The cables and bow string assembly of a conventional compound bow extends over eccentric wheels or pulleys attached to the outer ends of the bow limbs and the cables are spaced inwardly toward the bow handle from the bow string and laterally from the bow string. Usually the lateral spacing of the cables from the bow string is insufficient to assure the free passage of an arrow. Accordingly the cables 14 in FIG. 1 are shown pulled and held in lateral spaced relationship with the bow string 12 sufficiently to assure free passage of an arrow by a novel cable guard which will now be described.

The cable guard comprises a round rod generally indicated at 16 connected at one end to that side of the intermediate portion of handle section 10 opposite the arrow side and extends therefrom parallel to the plane of the bow string and bow, beyond the cables when the bow is fully drawn. Rod 16 is also spaced laterally from the bow string and cables and on that side of the cables opposite the bow string. The connected end portion 15 and the opposite and parallel free end portion 17 of the rod 16 are offset from each other by the forming of intermediate rod portion 19 at an acute angle to the end portions. The end portion 15 of rod 16 is mounted for rotation in a bore 18 in a plate 20 attached to the handle section 10 by screws 22. The free outer end portion 17 of rod 16 may therefore be swung toward or away from the cables 14 as indicated by arrows in FIG. 1. The connected end portion 15 is provided with annular grooves 24 and set screws 26 threadedly engaged in plate 20 are entered into the grooves 24 when tightened to fix the outer end portion 17 of rod 16 in an adjusted angular position.

Slidably and rotatably mounted on the free end portion 17 of rod 16 is a cable retaining member generally indicated at 28 having a bore 30 therethrough which slidably receives the free end portion 17 of rod 16. The cable retaining member 28 is further provided with a pair of adjacent parallel through bores 32 of somewhat smaller diameter extending perpendicular to the bore 30 and sized to slidably receive the cables 14. The member 28 is yet further provided with access slots 34 in opposite sides thereof extending parallel with and intersecting the bores 32. The access slots 34 are of less width than the diameter of the bores 32 and permit the snap-in lateral entry of cables 14 into bores 32 by a slight deformation of the material of which member 28 is constructed.

Preferably the cable retaining member 28 is constructed as a molding of a thermoplastic material having a relatively low coefficient of friction, sufficient tensile and shear strength for the purpose and sufficient flexibility to permit the deformation required for the lateral entry of the cables through the access slots 34 into bores 32 and the subsequent recovery to original shape. Thermoplastic materials suitable for forming member 28 by molding and having the afore mentioned properties are currently available commercially.

FIG. 1 shows the cables 14 slidably retained in cable retaining member 28 with rod 16 angularly adjusted so that cables 14 are pulled laterally away from bow string 12 just sufficiently to assure the free passage of an arrow. In this angularly adjusted position the free end portion 17 of rod 16 is sufficiently spaced laterally from the bow string 12 to avoid any interference therewith under shooting conditions. By way of comparison a cable guard rod **16*a* and cables 14*a* are shown in dotted line in FIG. 1 with the rod 14*a* shown positioned in the conventional manner between cables 14*a* and bow string 12. It will be seen that when rod 16*a* is spaced laterally from bow string 12 an amount equal to that which portion 17 of rod 16 is spaced therefrom, to avoid interference with the bow string under shooting conditions, that the cables are displaced or stressed considerably more than they are when employing member 28** and with the rod moved outward from between the bow string and cables.

It will be understood that the cable retaining member 28 may be slidably mounted on an existing cable guard rod attached to a bow thereby permitting overstressed cables to be moved from their conventional position on that side of the existing rod remote from the bow string to a considerably less stressed position in the cable retaining member on that side of the rod adjacent the bow string. The exclusive use of the cable retaining member alone as an accessory to be slidably and rotatably mounted on an existing cable guard rod is contemplated.

We claim:

1. In combination with a compound bow having a handle section and a pair of bow limbs, a bow string and a pair of cables extending between the outer ends of the bow limbs in lateral spaced relationship, with respect to the plane of the bow and bow string, and a cable guard comprising a rod connected at one end to said handle section and extending therefrom parallel to said plane and in outward spaced relationship with that side of said cables opposite said bow string to a free end beyond said cables when the bow is fully drawn, and a cable retaining member slidably mounted on said rod and having a pair of bores therethrough perpendicular to said rod slidably receiving said cables therein whereby an intermediate portion of the length of said cables is pulled laterally away from said bow string.

* * * * *